US010569405B2

(12) United States Patent
Kikuchi

(10) Patent No.: US 10,569,405 B2
(45) Date of Patent: Feb. 25, 2020

(54) IMPACT TOOL

(71) Applicant: HITACHI KOKI CO., LTD., Tokyo (JP)

(72) Inventor: Atsuyuki Kikuchi, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 224 days.

(21) Appl. No.: 15/523,354

(22) PCT Filed: Sep. 29, 2015

(86) PCT No.: PCT/JP2015/077477
§ 371 (c)(1),
(2) Date: Apr. 28, 2017

(87) PCT Pub. No.: WO2016/067806
PCT Pub. Date: May 6, 2016

(65) Prior Publication Data

US 2017/0246736 A1 Aug. 31, 2017

(30) Foreign Application Priority Data

Oct. 29, 2014 (JP) ..... 2014-220753

(51) Int. Cl.
*B25D 16/00* (2006.01)
*B25D 11/04* (2006.01)

(52) U.S. Cl.
CPC ..... *B25D 16/00* (2013.01); *B25D 11/04* (2013.01); *B25D 2216/0015* (2013.01); *B25D 2216/0023* (2013.01); *B25D 2250/201* (2013.01)

(58) Field of Classification Search
CPC ..... B25D 16/00
(Continued)

(56) References Cited

U.S. PATENT DOCUMENTS

2003/0116333 A1 6/2003 Voulkidis et al.
2005/0145403 A1* 7/2005 Kikuchi ..... B25D 11/005 173/201

(Continued)

FOREIGN PATENT DOCUMENTS

DE 10-2012-005803 A1 9/2013
JP 2003-191178 A 7/2003

(Continued)

OTHER PUBLICATIONS

Extended European Search Report issued in corresponding European Patent Application No. 15855130.9-1019/3213874, dated May 8, 2018.

(Continued)

*Primary Examiner* — Hemant Desai
*Assistant Examiner* — Amelia Jae-Ippel Vorce
(74) *Attorney, Agent, or Firm* — McDermott Will & Emery LLP

(57) ABSTRACT

Provided is an impact tool which can perform control in accordance with working situations. The impact tool converts a torque of a brushless motor into a striking force and applies it to a tip tool. The impact tool includes: a motor control unit which makes detection about whether the tip tool is pressed against an object during the rotation of the brushless motor; and a motor control unit which performs speed increase control for increasing the rotational speed of the brushless motor when a state of pressing the tip tool against the object has been detected continuously for a predetermined time.

6 Claims, 9 Drawing Sheets

(58) Field of Classification Search
USPC ..... 173/93.5
See application file for complete search history.

(56) References Cited

U.S. PATENT DOCUMENTS

| | | | | |
|---|---|---|---|---|
| 2006/0108132 | A1 | 5/2006 | Yamazaki | |
| 2009/0236110 | A1* | 9/2009 | Iwakami | B25D 11/005 173/122 |
| 2010/0163260 | A1 | 7/2010 | Berger et al. | |
| 2013/0140050 | A1* | 6/2013 | Eshleman | B25B 21/00 173/1 |
| 2013/0153253 | A1* | 6/2013 | Ludy | B25D 11/04 173/104 |
| 2015/0136433 | A1* | 5/2015 | Nitsche | B25D 16/006 173/2 |

FOREIGN PATENT DOCUMENTS

| | | | | |
|---|---|---|---|---|
| JP | 2006-142459 | A | 6/2006 | |
| JP | 2008-178935 | A | 8/2008 | |
| JP | 2008-543588 | A | 12/2008 | |
| JP | 2009-113122 | A | 5/2009 | |
| WO | 2013/174600 | A1 | 11/2013 | |
| WO | WO-2014144946 | A2 * | 9/2014 | B25B 23/14 |

OTHER PUBLICATIONS

Search Report issued in corresponding International Patent Application No. PCT/JP2015/077477, dated Dec. 15, 2015.

* cited by examiner

IMPACT TOOL

CROSS REFERENCE

This application is the U.S. National Phase under 35 U.S.C. § 371 of International Application No. PCT/JP2015/077477, filed on Sep. 29, 2015, which claims the benefit of Japanese Application No. 2014-220753, filed on Oct. 29, 2014, the entire contents of each are hereby incorporated by reference.

TECHNICAL FIELD

The present invention relates to an impact tool which strikes a tip tool.

BACKGROUND ART

Patent Document 1 discloses an impact tool which strikes a tip tool using pressure in a pressure chamber. The impact tool disclosed in Patent Document 1 includes: a cylindrical cylinder provided in a casing; a piston reciprocally housed in the cylinder; a tip tool held by the cylinder; a striking element reciprocally provided in the cylinder; an intermediate striking element disposed between the tip tool and the striking element in the cylinder; and an air chamber formed between the piston and the striking element in the cylinder. A respiration hole communicating with the air chamber is formed on the cylinder. Provided in the casing are a motor, and a power conversion mechanism for converting a torque by an output shaft of the motor into a reciprocating force for the piston.

In the impact tool disclosed in Patent Document 1, the torque by the output shaft of the motor is converted into the reciprocating force of the piston. When the piston moves in a direction separated from the striking element, the pressure in the air chamber decreases. In contrast to this, when the piston moves in a direction approaching the striking element, the pressure in the air chamber increases to apply a striking force to the tip tool through the intermediate striking element.

RELATED ART DOCUMENTS

Patent Documents

Patent Document 1: Japanese Patent Application Laid-Open No. 2009-113122

SUMMARY OF THE INVENTION

Problems to be Solved by the Invention

It is desired to control the impact tool disclosed in Patent Document 1 in accordance with working situations.

It is an object of the present invention to provide the impact tool which can be controlled in accordance with the working situations.

Means for Solving the Problems

An impact tool according to the present invention is an impact tool which converts a torque of a motor into a striking force and applies the force to a tip tool, and includes: a pressing detection unit that makes detection about whether the tip tool is pressed against an object during rotation of the motor; and a motor control unit that performs speed increase control for increasing a rotational speed of the motor when a state of pressing the tip tool against the object has been detected continuously for a predetermined time.

Effects of the Invention

The present invention can control the rotational speed of the motor in accordance with the working situations, and thus its workability is improved.

BRIEF DESCRIPTIONS OF THE DRAWINGS

DETAILED DESCRIPTION OF PREFERRED EMBODIMENTS

Figure 1:
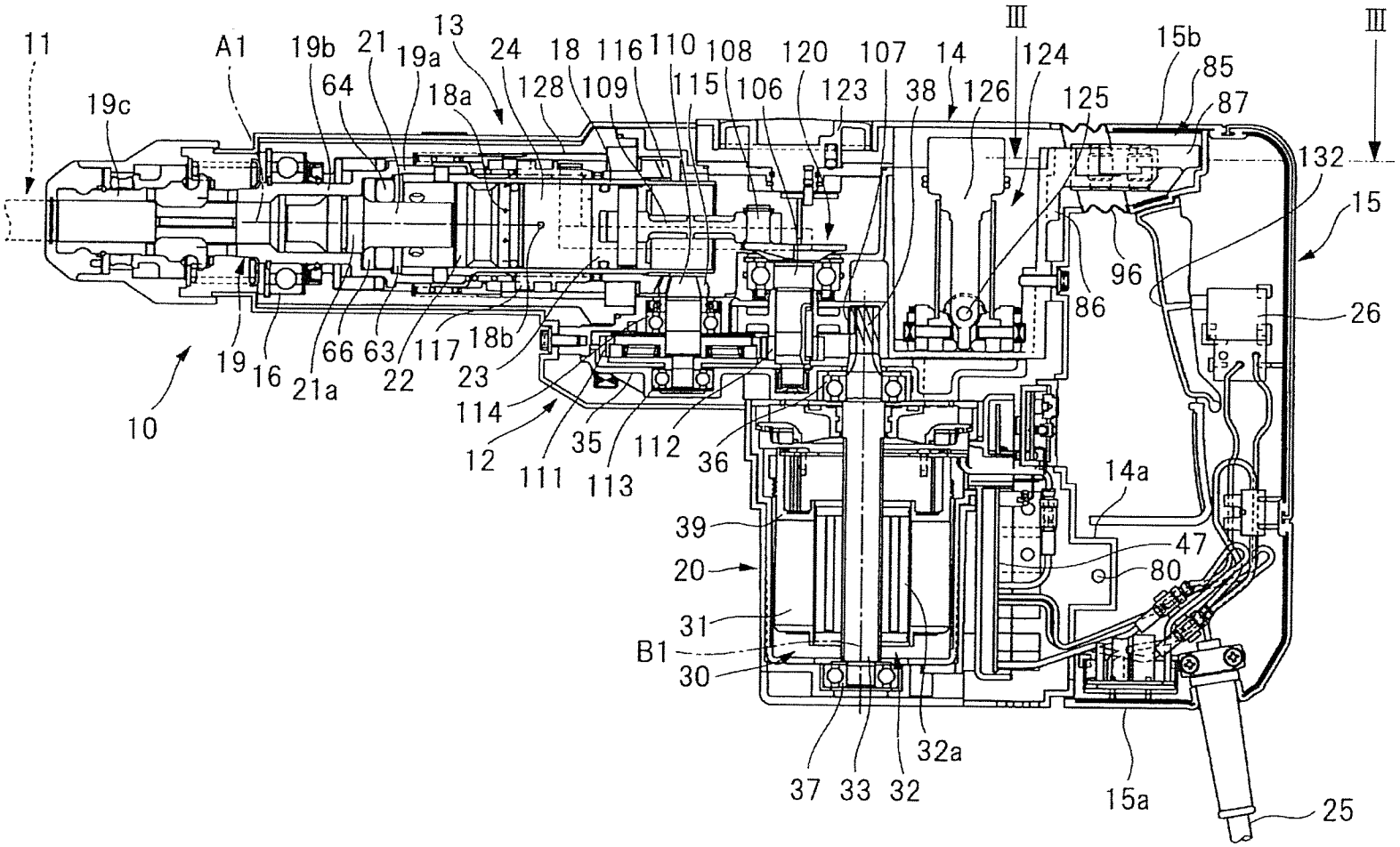
FIG. 1 is a front sectional view of an impact tool according to a first embodiment of the present invention.

Embodiments of the present invention will be described in detail below with reference to the accompanying drawings.

First Embodiment

An impact tool according to a first embodiment of the present invention will be described with reference to FIGS. 1 to 3. An impact tool 10 is also called a hammer drill, to and from which a tip tool 11 is attached and detached. The impact tool 10 is used for drilling work through objects, chipping work off the objects, and crushing work of objects. The objects include concrete and stone materials.

The impact tool 10 includes a tool body 12. The tool body 12 is assembled by fixing a cylinder case 13, an intermediate case 14, and a motor case 20 to each other. In addition, the tool body 12 is provided with a handle 15 which is gripped by an operator and which is movable to the tool body 12. The cylinder case 13 has a tubular shape. A holding tube 128 is provided in the cylinder case 13. A cylindrical cylinder 18 is provided in the holding tube 128.

The holding tube 128 is fixed so as not to rotate relative to the cylinder case 13 and move in a direction along a central line A1. The holding tube 128 and the cylinder 18 are arranged concentrically with respect to the central line A1 serving as their centers. A cylindrical tool holding jig 19 is provided concentrically with the cylinder 18. The tool holding jig 19 is provided so as to extend outside the cylinder case 13 from inside the holding tube 128. A bearing 16 is provided between the tool holding jig 19 and the holding tube 128. The bearing 16 rotatably supports the tool holding jig 19. The cylinder 18 is integrally rotatably coupled to the tool holding jig 19. The cylinder 18 and the tool holding jig 19 are positioned and fixed with respect to the holding tube 128 in the direction along the central line A1.

The tool holding jig 19 includes: a large-diameter portion 19*a*; an intermediate-diameter portion 19*b* continuous with the large-diameter portion 19*a*; and a small-diameter portion 19*c* continuous with the intermediate-diameter portion 19*b*. The large-diameter portion 19*a* has a larger inner diameter than the intermediate-diameter portion 19*b*. The intermediate-diameter portion 19*b* has a larger inner diameter than the small-diameter portion 19*c*. The intermediate-diameter portion 19*b* is disposed between the large-diameter portion 19*a* and the small-diameter portion 19*c* in the direction along the central line A1. An inner surface of the large-diameter portion 19*a* is coupled continuously with an inner surface of the intermediate-diameter portion 19*b* through a stepped portion 19*d*. Also, the inner surface of the intermediate-diameter portion 19*b* is coupled continuously with an inner surface of the small-diameter portion 19*c* through a tapered surface 19*e*. The tip tool 11 is attached inside the small-diameter portion 19*c* of the tool holding jig 19. A torque of the cylinder 18 is transmitted to the tip tool 11.

A metal intermediate striking element 21 is provided so as to extend inside the cylinder 18 from inside the tool holding jig 19. The intermediate striking element 21 can reciprocate in the direction along the central line A1. The intermediate striking element 21 includes a large-diameter portion 21*a*. The large-diameter portion 21*a* has a larger outer diameter than the remaining portion of the intermediate striking element 21. Provided in the cylinder 18 is a striking element 22 which strikes the intermediate striking element 21. The striking element 22 can reciprocate in the direction along the central line A1.

Provided in the tool holding jig 19 are further a washer 63, a damper 64, and a stopper 66. The washer 63, the damper 64, and the stopper 66 are arranged between the cylinder 18 and the stepped portion 19*d*. This inhibits the washer 63, the damper 64, and the stopper 66 from moving relative to the holding tube 128 and the cylinder case 13 in the direction along the central line A1.

The intermediate striking element 21 can move within a predetermined range in the direction along the central line A1. When the intermediate striking element 21 moves in a direction away from a piston 23, the large-diameter portion 21*a* comes into contact with the tapered surface 19*e* and stops. In contrast to this, when the intermediate striking element 21 moves in a direction approaching the piston 23, the large-diameter portion 21*a* comes into contact with the stopper 66 and stops.

Additionally, the piston 23 is disposed in the cylinder 18. The piston 23 can reciprocate in the direction along the central line A1. An air chamber 24 is provided between the striking element 22 and the piston 23 in the cylinder 18. Provided are a respiration hole 18*b* and idle striking preventing holes 18*a* which radially penetrate through the cylinder 18. The respiration hole 18*b* makes the air chamber 24 communicate with an outside of the cylinder 18 regardless of a position of the striking element 22 and a position of the piston 23 in the direction along the central line A1. The idle striking preventing holes 18*a* open and close in accordance with an operation of the striking element 22. When the idle striking preventing holes 18*a* open, the air chamber 24 communicates with the outside of the cylinder 18 through the idle striking preventing holes 18*a*.

The intermediate case 14 is disposed between the handle 15 and the cylinder case 13 in the direction along the central line A1. The motor case 20 is fixed to the cylinder case 13 and the intermediate case 14. A placement range of the motor case 20 in the direction along the central line A1 overlaps a placement range of the intermediate case 14 in the direction along the central line A1. The handle 15 is bent in an arch shape. Both ends of the handle 15 are attached to the intermediate case 14. The handle 15 is provided with a trigger 132 and a feed cable 25. Provided in the handle 15 is also a trigger switch 26. The trigger switch 26 is turned on when an operating force is applied to the trigger 132, and is turned off when the operating force applied to the trigger 132 is released.

The motor case 20 is molded integrally with a conductive metal material, e.g., aluminum. The motor case 20 has a tubular shape and houses a brushless motor 30 therein. The brushless motor 30 is a DC motor. The brushless motor 30 includes a tubular stator 31, and a rotor 32 disposed inside the stator 31. The rotor 32 includes an output shaft 33, a rotor core 32*a* fixed to the output shaft 33, and a permanent magnet attached to the rotor core 32*a*. The stator 31 includes a three-phase coil, namely, coils U1, V1, and W1 corresponding to a U phase, a V phase, and a W phase.

When seen from a front view of the impact tool 10, a central line B1 as a rotational center of the output shaft 33 is perpendicular to the central line A1. A partition 35 is provided so as to extend inside the intermediate case 14 from inside the cylinder case 13. Provided are a bearing 36 supported by the partition 35, and a bearing 37 supported by a motor case 27. The two bearings 36 and 37 are arranged at different positions in a direction along the central line B1 of the output shaft 33. The bearings 36 and 37 rotatably support the output shaft 33. A drive gear 38 is provided on an outer circumferential surface of the output shaft 33 which is disposed inside the intermediate case 14.

Explained will be a power conversion mechanism 120 which converts a torque of the output shaft 33 of the brushless motor 30 into a reciprocating force for the piston 23. First of all, provided in the intermediate case 14 is rotatably a crank shaft 106. The crank shaft 106 is parallel, to the output shaft 33. A driven gear 107 provided on the crank shaft 106 meshes with the drive gear 38. A crank pin 108 is attached to the crank shaft 106 so as to be eccentric from a rotational center of the crank shaft 106.

Additionally, provided is a connecting rod 109 that couples the crank pin 108 and the piston 23 so as to enable power transmission. Moreover, when the torque of the output shaft 33 is transmitted to the crank shaft 106 and the crank pin 108 revolves, the piston 23 reciprocates inside the cylinder 18. The power conversion mechanism 120 is constituted by the crank shaft 106, the crank pin 108, and the connecting rod 109.

A torque transmission mechanism which transmits the torque of the output shaft 33 to the tip tool 11 will be described next. Provided in the cylinder case 13 is rotatably a torque transmission shaft 110. The torque transmission shaft 110 is provided with a driven gear 111. The driven gear 111 meshes with a drive gear 112 of the crank shaft 106. Supported by bearings 113 and 114 is rotatably the torque transmission shaft 110. This allows the torque of the output shaft 33 to be transmitted to the torque transmission shaft 110 through the crank shaft 106. In addition, the torque transmission shaft 110 is provided with a bevel gear 115.

On the other hand, a cylindrical bevel gear 116 is attached to an outer circumference of the cylinder 18, and rotatable relative to the cylinder 18. A bearing 127 which rotatably supports the bevel gear 116 and the cylinder 18 is provided between the bevel gear 116 and the holding tube 128. The bevel gear 116 meshes with the bevel gear 115. A sleeve 117 is attached onto the outer circumference of the cylinder 18 so as to be rotatable together with the cylinder 18 and movable in the direction along the central line A1. The impact tool 10 includes a mode switching dial 123. The operator operates the mode switching dial 123 to switch from one of a rotating/striking mode and a striking mode to the other. When the operator operates the mode switching dial 123, the sleeve 117 moves in the direction along the central line A1. In addition, provided is a clutch mechanism that engages the sleeve 117 and the bevel gear 116 or disengages their engagement.

When the sleeve 117 moves relative to the cylinder 18 along the central line A1, the sleeve 117 is engaged with the bevel gear 116 so as to enable the power transmission or disengaged from the bevel gear 116. If the rotating/striking mode is selected, the sleeve 117 is engaged with the bevel gear 116, and a torque of the torque transmission shaft 110 is transmitted to the cylinder 18. In contrast to this, if the striking mode is selected, the sleeve 117 is disengaged from the bevel gear 116, and the torque of the torque transmission shaft 110 is not transmitted to the cylinder 18.

Provided in the intermediate case 14 is a vibration damping mechanism 124 located between the power conversion mechanism 120 and the handle 15 in the direction along the central line A1. The vibration damping mechanism 124 includes a spindle 126. The spindle 126 is swung through a support shaft 125 serving as a fulcrum. The spindle 126 is swung within a predetermined angle range along a planar direction including the central lines A1 and B1.

The handle 15 further includes a first tubular portion 15*a* and a second tubular portion 15*b*, which extend toward the intermediate case 14. The first tubular portion 15*a* and the second tubular portion 15*b* are arranged at different positions in the direction along the central line E1. The intermediate case 14 includes a mount portion 14*a* protruding in the direction along the central line A1. The mount portion 14*a* is disposed in the first tubular portion 15*a*. Then, provided is a pivot shaft 80 that couples the mount portion 14*a* and the first tubular portion 15*a*. This allows the handle 15 to pivot about the pivot shaft 80 relative to the tool body 12 within the predetermined angle range.

Further, provided is an operation restriction mechanism 85 that extends inside the second tubular portion 15*b* and inside the intermediate case 14. Set by the operation restriction mechanism 85 is an angle through which the handle 15 pivots about the pivot shaft 80. The operation restriction mechanism 85 includes a stopper 86 provided in the intermediate case 14, and a contact member 87 provided in the second tubular portion 15*b*. The stopper 86 is made of steel and fixed inside the intermediate case 14. The stopper 86 includes a protruding portion 88 protruding toward the handle 15 along the central line A1. When seen from a plan view of the impact tool 10, the protruding portion 88 is provided with two holding grooves 89 on each of both sides of the central line A1. When seen from the plan view of the impact tool 10, the holding grooves 89 incline relative to the central line A1.

On the other hand, the contact member 87 is made of steel and fixed to the handle 15 with screw members 99. The contact member 87 includes two arm portions 90 protruding in the central line A1 direction. When seen from the plan view of the impact tool 10, the protruding portion 88 is disposed between the two arm portions 90. Each of the two arm portions 90 is provided with a holding groove 91. When seen from the plan view of the impact tool 10, the holding grooves 91 incline relative to the central line A1. The inclination direction of the holding groove 91 is the same as that of the holding groove 89. Moreover, rolling bodies 92 are interposed between the holding grooves 89 and the holding grooves 91. Each rolling body 92 is formed from a rubber-like elastic body.

The contact member 87 is also provided with a detected shaft 93. The detected shaft 93 is disposed between the two arm portions 90, and protrudes toward the intermediate case 14 in the central line A1 direction.

The protruding portion 88 is provided with a hole 94. The hole 94 opens at a distal end of the protruding portion 88. The detected shaft 93 is disposed in the hole 94. The detected shaft 93 can move in the hole 94 in the direction along the central line A1. By making a spherical portion 93*a* of a distal end of the detected shaft 93 abut on an arc surface 94*a* of the hole 94, movements of the detected shaft 93 and the handle 15 is restricted. A proximity sensor 60 is attached to the arc surface 94*a* of the hole 94 in the stopper 86.

The proximity sensor 60 outputs a signal when a distance between the proximity sensor 60 and the detected shaft 93 in the central line A1 direction becomes equal to or less than a predetermined distance set in advance. That is, the proximity sensor 60 outputs a signal when the handle 15 is in a pressed state, and outputs no signal when the handle 15 is in an unpressed state. Note that each meaning of the pressed state and the unpressed state will be described later.

As the proximity sensor 60, for example, a high-frequency transmission type sensor can be used. Note that a boot 96 is provided to seal a gap between the second tubular portion 15*b* and the intermediate case 14. The boot 96 is obtained by molding a rubber-like elastic body into a bellows shape.

Figure 4:
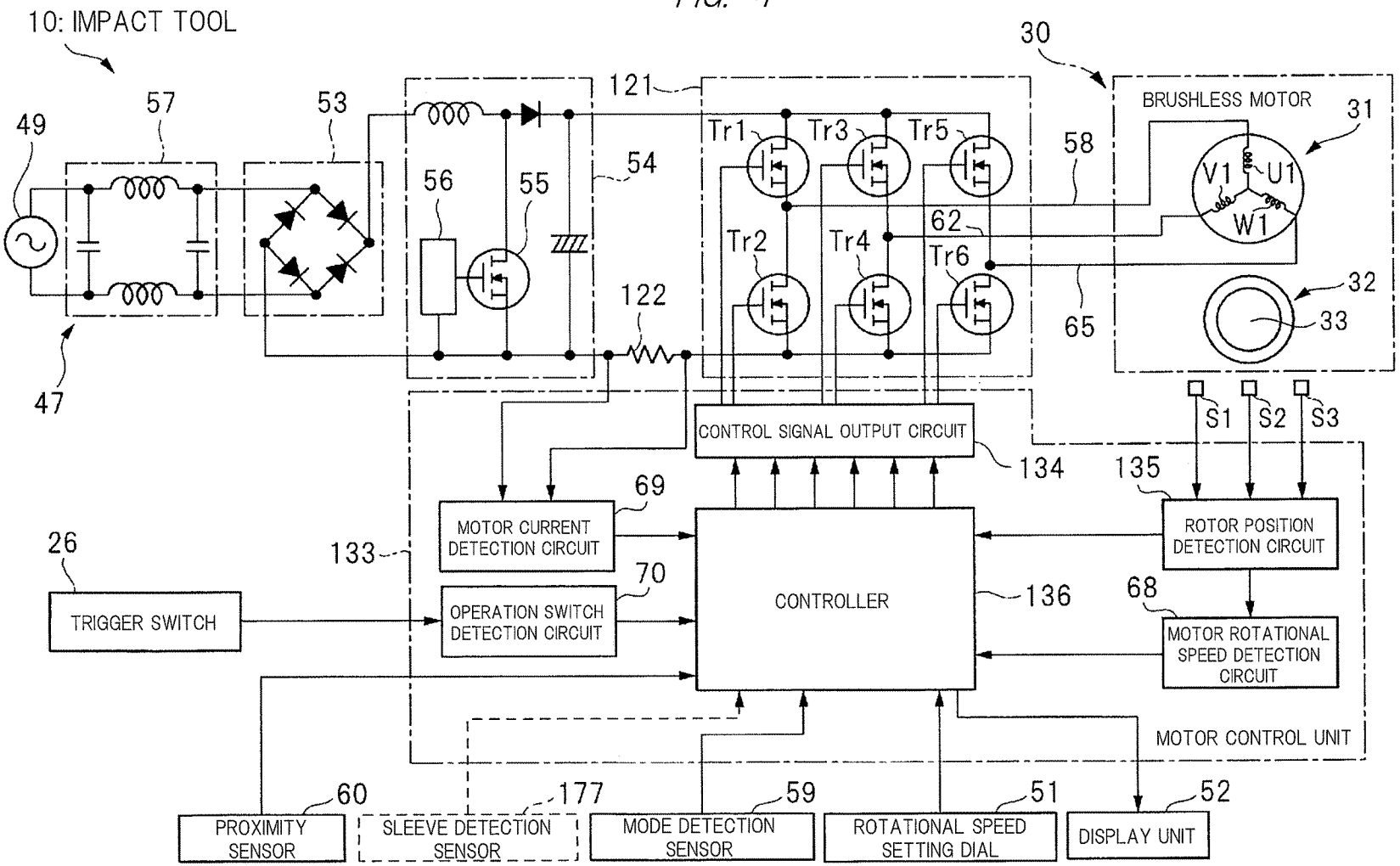
FIG. 4 is a block diagram showing a control circuit of the impact tool according to the present invention.

FIG. 4 is a block diagram showing a control circuit which controls the impact tool 10. The brushless motor 30 uses an AC power source 49 as a power source. Power from the AC power source 49 flows into coils of the brushless motor 30 through the feed cable 25. The impact tool 10 includes a rotational speed setting dial 51 for setting a target rotational speed for the brushless motor 30. The operator can switch the target rotational speed to a plurality of ranks, for example, six ranks by operating the rotational speed setting dial 51. The impact tool 10 has a display unit 52. The display unit 52 includes a display and an LED lamp. The display unit 52 displays the target rotational speed, and a control state of the brushless motor 30.

In addition, three magnetic sensors S1 to S3 output detection signals each representing a rotational position of the rotor 32. The three magnetic sensors S1 to S3 are provided in correspondence with the three-phase coils U1, V1, and W1. The magnetic sensors S1 to S3 each are a noncontact sensor which detects a magnetic force generated by a permanent magnet (s) attached to the rotor 32, converts the magnetic force into an electrical signal, and outputs it. Hall elements can be used as the magnetic sensors S1 to S3.

The impact tool 10 includes an inverter circuit 121 which controls a current supplied to each of the coils U1, V1 and W1. Provided on electrical circuits between the AC power source 49 and the inverter circuit 121 are a rectifying circuit 53 for rectifying an AC current of the AC power source 49 into a DC current, and a power factor improving circuit 54 for boosting a voltage of the rectified DC current to supply it to the inverter circuit 121. The rectifying circuit 53 is formed by bridge-connecting a plurality of diodes. The power factor improving circuit 54 includes an integrated circuit 56 which outputs a PWM control signal to a transistor 55 formed by a field-effect transistor or the like. An anti-noise circuit 57 is further provided between the AC power source 49 and the rectifying circuit 53 in order to prevent noises generated by the inverter circuit 121 from being transferred to the AC power source 49.

The inverter circuit 121 is a three-phase full-bridge inverter circuit, which includes two switching elements Tr1 and Tr2 connected to each other, two switching elements Tr3 and Tr4 connected to each other, and two switching elements Tr5 and Tr6 connected to each other. The switching elements Tr1 and Tr2 are connected in parallel with each other, and connected to a lead wire 58. The lead wire 58 is connected to the coil U1.

The switching elements Tr3 and Tr4 are connected in parallel with each other, and connected to a lead wire 62. The lead wire 62 is connected to the coil V1. The switching elements Tr5 and Tr6 are connected in parallel with each other, and connected to a lead wire 65. The lead wire 65 is connected to the coil W1.

The switching elements Tr1, Tr3, and Tr5 are connected to a positive output terminal of the power factor improving circuit 54. The switching elements Tr2, Tr4, and Tr6 are connected to a negative terminal of the power factor improving circuit 54 via a current detection resistor 122.

Thus, the three switching elements Tr1, Tr3, and Tr5 connected to a positive side of the power factor improving circuit 54 are located on a high side. The three switching elements Tr2, Tr4, and Tr6 connected to a negative side of the power factor improving circuit 54 are located on a low side. The coils U1, V1, and W1 are mutually connected, and the respective coils U1, V1, and W1 configure a star connection.

Note that a connection scheme of the coils U1, V1, and W1 may be a delta connection. For example, when control signals are applied to a gate of the switching element Tr1 on the high side and a gate of the switching element Tr4 on the low side, currents are supplied to the U-phase and V-phase coils U1 and V1. By controlling ON/OFF timing and an ON period of each of the switching elements Tr1 to Tr6, a commutation operation of each of the coils U1, V1, and W1 is controlled.

Provided in the tool body 12 is a control board 47. The control board 47 is provided with a motor control unit 133. The motor control unit 133 computes and outputs a control signal for controlling the inverter circuit 121. The motor control unit 133 includes a controller 136, a control signal output circuit 134, a rotor position detection circuit 135, a motor rotational speed detection circuit 68, a motor current detection circuit 69, and an operation switch detection circuit 70. Detection signals from the magnetic sensors S1 to S3 are sent to the rotor position detection circuit 135. The rotor position detection circuit 135 detects a rotational position of the rotor 32. The rotational position of the rotor 32 indicates the phase of the rotor 32 in the rotational direction, and a positional relationship or angle defined between a reference position set by a fixed element such as the stator 31 in advance in the rotational direction and a reference position set by the rotor 32 in advance in the rotational direction.

The rotor position detection circuit 135 processes a signal representing the rotational position of the rotor 32. The signal outputted from the rotor position detection circuit 135 is sent to the controller 136 and the motor rotational speed detection circuit 68. The motor rotational speed detection circuit 68 detects a motor rotational speed. The signal outputted from the motor rotational speed detection circuit 68 is inputted to the controller 136.

The motor current detection circuit 69 is connected to both ends of the current detection resistor 122. The motor current detection circuit 69 detects a current flowing in the brushless motor 30. Further, the signal outputted from the motor current detection circuit 69 is inputted to the controller 136. Provided is a mode detection sensor 59 that detects a mode selected by the mode switching dial 123. The signal outputted from the mode detection sensor 59 is inputted to the controller 136. In addition, the signal outputted from the proximity sensor 60 is inputted to the controller 136.

The controller 136 includes a microprocessor which processes a control signal, and a memory. The memory stores control programs, arithmetic expressions, data, and the like. The controller 136 processes the signal inputted from the motor rotational speed detection circuit 68, and computes an actual rotational speed of the rotor 32. The controller 136 can control the rotational speed of the brushless motor 30 based on the signal inputted from the rotational speed setting dial 51, the signal inputted from the proximity sensor 60, the actual rotational speed of the rotor 32, and the like. The signal outputted from the controller 136 is inputted to the control signal output circuit 134. The inverter circuit 121 is controlled by a control signal inputted from the control signal output circuit 134.

A usage example of the above impact tool 10 will be described. When the operator turns on or off the trigger switch 26 by operating the trigger 132, the ON or OFF signal outputted from the operation switch detection circuit 70 is sent to the controller 136. When the controller 136 detects the turning-on of the trigger switch 26, the control signal outputted from the control signal output circuit 134 is inputted to the inverter circuit 121 to individually turn on/off the switching elements Tr1 to Tr6. As a consequence, currents sequentially flow in the coils U1, V1, and W1. The coils U1, V1, and W1, and a permanent magnet (s) attached onto the rotor core 32*a* then cooperatively create a rotating magnetic field, and thus the rotor 32 is rotated.

The motor control unit 133 executes control to bring the actual rotational speed of the rotor 32 close to a target rotational speed. The actual rotational speed of the rotor 32 is controlled by adjusting voltages applied to the respective coils U1, V1, and W1. More specifically, this control is performed by adjusting duty ratios of the ON signals applied to the gates of the respective switching elements Tr1 to Tr6 in the inverter circuit 121. As the duty ratios increase, the rotational speed of the brushless motor 30 increases.

When the rotor 32 of the brushless motor 30 rotates, the power conversion mechanism 120 converts the torque of the output shaft 33 into a reciprocating force for the piston 23, and the piston 23 reciprocates inside the cylinder 18.

Meanwhile, an elastic restoring force of each rolling body 92 is transmitted to the handle 15 through the contact member 87. That is, the handle 15 is biased clockwise about the pivot shaft 80 in FIG. 1. Here, when the tip tool 11 is away from an object and the handle 15 is not pressed against the tool body 12, the spherical portion 93*a* of the detected shaft 93 comes into contact with the arc surface 94*a* of the hole 94, and the handle 15 stops at a predetermined position relative to the tool body 12. A state in which the spherical portion 93*a* of the detected shaft 93 is in contact with the arc surface 94*a* of the hole 94 and the handle 15 is at rest at a predetermined position relative to the tool body 12 will be called an unpressed state. Incidentally, when the handle 15 is in the unpressed state, the distance between the proximity sensor 60 and the detection shaft 93 becomes equal to or more than a predetermined distance, and so the proximity sensor 60 outputs no signal.

In addition, when the tip tool 11 is directed downward and is away from an object, the intermediate striking element 21 and the striking element 22 descend under their own weights, and the large-diameter portion 21*a* comes into contact with the tapered surface 19*e*. Both the intermediate striking element 21 and the striking element 22 then stop. For this reason, the idle striking preventing holes 18*a* open, and the air chamber 24 communicates with an outside of the cylinder 18. As a consequence, even if the piston 23 operates, the pressure in the air chamber 24 dose not increase, and hence no striking force is applied to the tip tool 11. Namely, this can prevent idle striking.

In contrast to this, when the operator grips the handle 15 and presses the tip tool 11 against the object, a resultant reactive force moves the intermediate striking element 21 toward the air chamber 24 to cause the large-diameter portion 21*a* to come into contact with the stopper 66, and thereby the intermediate striking element 21 stops. When the large-diameter portion 21*a* of the intermediate striking element 21 comes into contact with the stopper 66 and stops, the idle striking preventing holes 18*a* are closed by the striking element 22.

Moreover, the pressing force applied to the handle 15 is transmitted to the tool body 12 through the contact member 87, the rolling bodies 92, and the stopper 86. In this case, before the large-diameter portion 21*a* of the intermediate striking element 21 comes into contact with the stopper 66, since the tool body 12 moves in a direction approaching the object, the rolling bodies 92 receive no compressive load.

In contrast to this, after the large-diameter portion 21*a* of the intermediate striking element 21 comes into contact with the stopper 66, the handle 15 pivots counterclockwise in FIG. 1 about the pivot shaft 80 relative to the tool body 12. Consequently, the contact member 87 approaches the stopper 86 in the central line A1 direction. The rolling bodies 92 then roll along the holding grooves 89 and 91, receive compressive loads by being sandwiched between the stopper 86 and the contact member 87, and thereby are elastically deformed.

Then, when the contact member 87 comes into contact with the stopper 86, the handle 15 stops. A state in which the contact member 87 is in contact with the stopper 86 and the handle 15 is at rest will be called a pressed state. Additionally, if the distance between the proximity sensor 60 and the detection shaft 93 is less than a predetermined distance while the handle 15 is pivoting or at rest, the proximity sensor 60 outputs a signal.

As described above, when the piston 23 moves in the direction approaching the crank shaft 106 in a state of pressing the tip tool 11 against the object and thereby the idle striking preventing holes 18*a* are closed, the air chamber 24 draws air through the respiration hole 18*b*. Further, when the piston 23 reaches a top dead center and then moves from the top dead center to a bottom dead center, the pressure in the air chamber 24 increases, and the striking element 22 strikes the intermediate striking element 21. The striking force applied to the intermediate striking element 21 is transmitted to the object through the tip tool 11. Subsequently, while the output shaft 33 of the brushless motor 30 rotates, the piston 23 reciprocates inside the cylinder 18 to intermittently strike the tip tool 11.

When the piston 23 reciprocates and the striking element 22 intermittently strikes the intermediate striking element 21, the tool body 12 vibrates in the direction along the central line A1. The spindle 126 then swings about the support shaft 125 to reduce the vibration of the tool body 12.

Meanwhile, the torque of the output shaft 33 of the brushless motor 30 is transmitted to the torque transmission shaft 110 through the drive gear 112. When the operator selects the striking/rotating mode by operating the mode switching dial 123, the torque of the torque transmission shaft 110 is transmitted to the cylinder 18 to rotate it. The torque of the cylinder 18 is transmitted to the tip tool 11 through the tool holding tool 19. In this manner, the impact tool 10 transmits a striking force and a torque to the tip tool 11. In contrast to this, when the operator selects the striking mode by operating the mode switching dial 123, the torque of the torque transmission shaft 110 is not transmitted to the cylinder 18 regardless of whether the tip tool 11 is pressed against the object.

When the operator separates the tip tool 11 from the object after striking work in a state where the tip tool 11 is directed downward, the intermediate striking element 21 and the striking element 22 both descend under their own weights. The large-diameter portion 21*a* then comes into contact with the tapered surface 19*e*, and the intermediate striking element 21 and the striking element 22 both stop. This makes the idle striking preventing holes 18*a* open and the air chamber 24 communicate with the outside of the cylinder 18.

In addition, when the operator reduces the pressing force applied to the handle 15 in order to separate the tip tool 11 from the object, the handle 15 pivots clockwise about the pivot shaft 80 relative to the tool body 12 for the elastic restoring forces of the rolling bodies 92. Then, when the spherical portion 93*a* of the detected shaft 93 comes into contact with the arc surface 94*a* of the hole 94, the handle 15 stops relative to the tool body 12. That is, the handle 15 returns to the unpressed state.

Control examples which can be executed by the impact tool 10 in FIG. 1 will be described next.

Control Example 1

Figure 5:
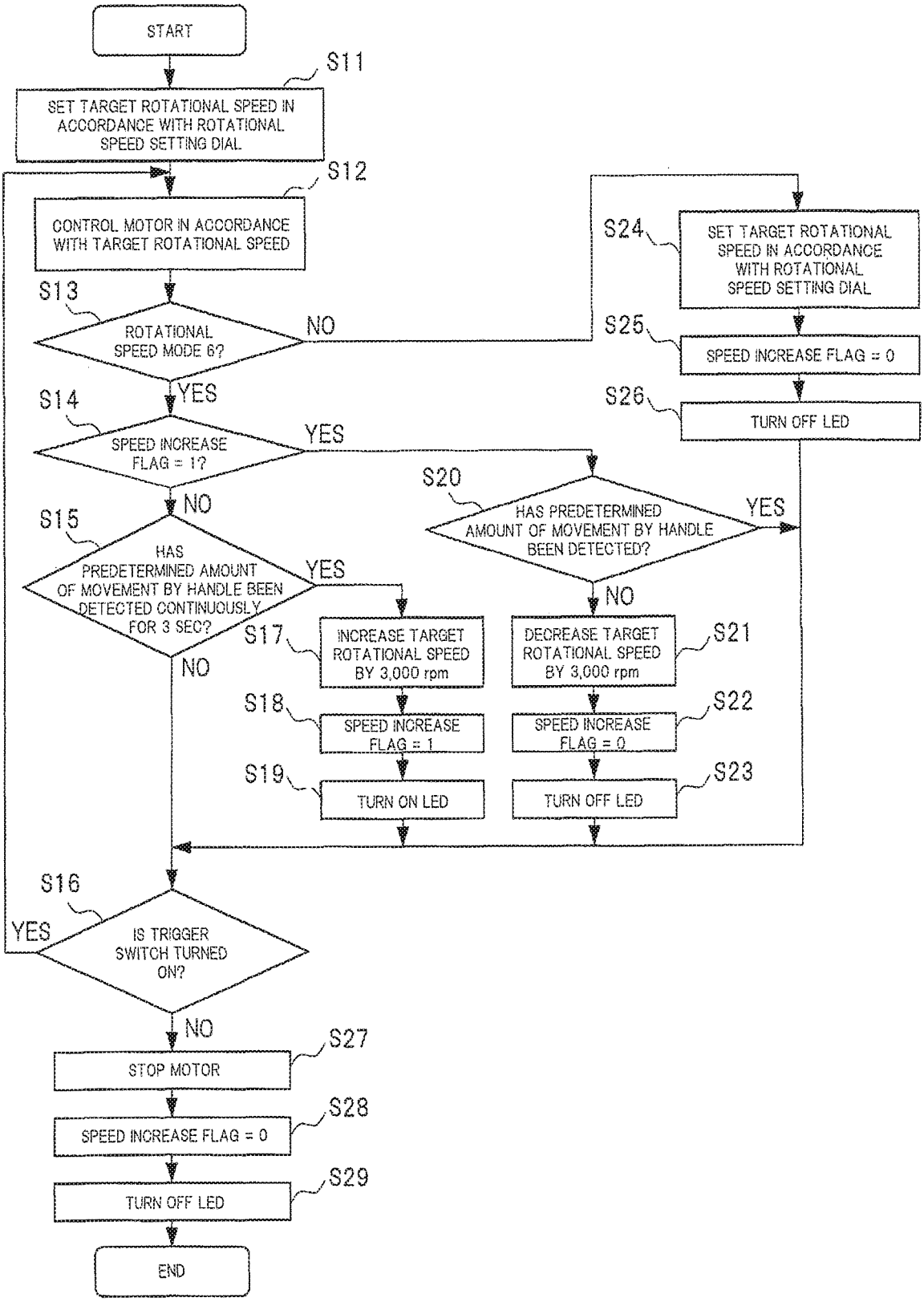
FIG. 5 is a flowchart showing control example 1 which can be executed by the impact tool according to the present invention.

FIG. 5 is a flowchart showing control example 1. First, the motor control unit 133 starts the flowchart of FIG. 5 upon detecting the turning-on of the trigger switch 26, and sets a target rotational speed for the brushless motor 30 based on an operation signal from the rotational speed setting dial 51 in step S11. The target rotational speed is the number of revolutions per unit time. For example, a target rotational speed of 3,000 rpm is set in rotational speed mode 1; a target rotational speed of 6,000 rpm is set in rotational speed mode 2; a target rotational speed of 9,000 rpm is set in rotational speed mode 3; a target rotational speed of 12,000 rpm is set in rotational speed mode 4; a target rotational speed of 15,000 rpm is set in rotational speed mode 5; and a target rotational speed of 18,000 rpm is set in rotational speed mode 6.

In step S12, the motor control unit 133 outputs, to the inverter circuit 121, a signal corresponding to a set rotational speed, and controls the actual rotational speed of the brushless motor 30. In step S13 following step S12, the motor control unit 133 determines whether rotational speed mode 6 is selected. Upon determining YES in step S13, the motor control unit 133 determines in step S14 whether "speed increase flag=1" is satisfied.

The speed increase flag means a condition for setting the actual rotational speed of the brushless motor 30 to a rotational speed higher than the target rotational speed selected by the rotational speed setting dial 51. "Speed increase flag=1" means that this condition is satisfied.

If the motor control unit 133 determines NO in step S14, the process advances to step S15 to determine whether the movement of the handle 15 from the unpressed state by a predetermined amount has been detected continuously for 3 sec. In this case, "the movement of the handle 15 from the unpressed state by a predetermined amount" means that the handle 15 is in the pressed state. The motor control unit 133 performs the determination in step S15 based on a signal from the proximity sensor 60. Upon determining NO in step S15, the motor control unit 133 determines in step S16 whether the trigger switch 26 is ON. If the motor control unit 133 determines YES in step S16, the process advances to step S12.

Upon determining YES in step S15, the motor control unit 133 performs in step S17 a process in which the target input rotational speed set at that time is increased by 3,000 rpm. In addition, the motor control unit 133 performs in step S18 a process for setting the rotational speed at "speed increase flag=1", and causes the display unit 52 to indicate execution of speed increase control in step S19. The process then advances to step S16. A process in step S19 includes causing the display unit 52 to turn on an LED lamp. If the process advances to step S12 via steps S17 and S16, the rotational speed used and set in step S12 is a target rotational speed increased by 3,000 rpm in step S17.

If the motor control unit 133 determines YES in step S14, the process advances to step S20 to determine whether a predetermined amount of movement by the handle 15 from the unpressed state has been detected. The motor control unit 133 performs the determination in step S20 based on a signal from the proximity sensor 60. When the handle 15 returns to the unpressed state, the motor control unit 133 determines NO in step S20. The process then advances to step S21. The motor unit 133 performs a process in which the target rotational speed set at that time is decreased by 3,000 rpm.

In addition, the motor control unit 133 performs a process of setting "speed increase flag=0" in step S22, and a process of turning off the LED lamp in step S23. The process then advances to step S16. "Speed increase flag=0" means that a condition for setting a rotational speed higher than the target rotational speed selected by the rotational speed setting dial 51 is not satisfied. If the process advances to step S12 via steps S21 and S16, the rotational speed used and set in step S12 is a target rotational speed decreased by 3,000 rpm in step S21. If the motor control unit 133 determines YES in step S20, the process advances to step S16.

In contrast, if the motor control unit 133 determines NO in step S13, the process advances to step S24 to control the actual rotational speed of the brushless motor 30 based on the target rotational speed set in accordance with the operation of the rotational speed setting dial 51. That is, if anyone of rotational speed modes 1 to 5 is set, the actual rotational speed of the brushless motor 30 is controlled to have a target rotational speed corresponding to the set one of these rotational speed modes. In addition, the motor control unit 133 sets "speed increase flag=0" in step S25, and turns off the LED lamp in step S26. The process then advances to step S16.

Next, if the motor control unit 133 determines NO in step S16, the process advances to step S27 to stop the brushless motor 30. Simultaneously therewith, the motor control unit 133 sets "speed increase flag=0" in step S28, and turns off the LED lamp in step S29. Then, the flowchart of FIG. 5 is finished.

In this manner, the target rotational speed of the brushless motor 30 where the pressed state of the handle 15 has been detected continuously for 3 sec is set by the motor control unit 133 so as to become higher than that where the pressed state of the handle 15 is for less than 3 sec. For example, when the operator performs the chipping work on the object by using the impact tool 10, if the pressed state of the handle 15 without crushing the object is detected continuously for 3 sec, the rotational speed of the brushless motor 30 increases, and the chipping workability improves.

In addition, upon detecting that the handle 15 has been returned from the pressed state to the unpressed state, the motor control unit 133 decreases the target rotational speed of the brushless motor 30. Therefore, an increase in power consumed by the brushless motor 30 can be suppressed when the work progresses properly.

Furthermore, the motor control unit 133 performs control to increase the target rotational speed of the brushless motor 30 as long as rotational speed mode 6 is selected and its maximum is 18,000 rpm settable as the target rotational speed. This can therefore prevent any accidental increase in the target rotational speed of the brushless motor 30.

Second Embodiment

An impact tool 10 according to a second embodiment of the present invention will be described with reference to FIGS. 6 and 7. The same reference numerals as in FIGS. 1 and 2 denote the same constituent elements in FIGS. 6 and 7. The impact tool 10 includes a brushless motor 30 as a power source for generating a striking force transmitted to a tip tool 151. In addition, the impact tool 10 converts the torque of the brushless motor 30 into a reciprocating force for a piston 153, and further causes an air chamber 154 to generate a striking force by a reciprocating movement of the piston 153. The striking force is transmitted to the tip tool 151 through an intermediate striking element 155.

A mechanism housing the brushless motor 30, and an arrangement for controlling the brushless motor 30 will be described first. The impact tool 10 includes a motor case 156, which houses the brushless motor 30 therein. Then, a striking housing 157 is fixed to the motor case 156.

Provided is also the intermediate case 14 which is fixed to the motor case 156 and the striking housing 157. The motor case 156, the striking housing 157, and the intermediate case 14 constitute a tool body 159. Then, provided is the handle 15 which is attached to the intermediate case 14.

Further, the striking housing 157 has a cylindrical shape, and one end of the striking housing 157 is fixed to the intermediate case 14. Additionally, provided in the striking housing 157 is a cylindrical cylinder 160. The cylinder 160 does not rotate relative to the striking housing 157, and cannot move in the central line A1 direction.

The piston 153 is disposed in the cylinder 160 so as to be able to reciprocate in the central line A1 direction. Additionally, the piston 153 is coupled to the connecting rod 109. In this manner, the output shaft 33 of the brushless motor 30 is coupled to the piston 153 through the crank shaft 106 and the connecting rod 109. With this structure, when the crank shaft 106 rotates by transmitting the torque of the output shaft 33 to the crank shaft 106, the torque of the crank shaft 106 is converted into a reciprocating force for the piston 153.

The cylinder 160 further houses a striking element 161 between the piston 153 and the tip tool 151 in the central line A1 direction. The striking element 161 can move in the direction along the central line A1. The air chamber 154 is formed between the striking element 161 and the piston 153 in the cylinder 160. The striking element 161 is an element which transmits, to an intermediate striking element 155, the striking force generated by an increase in the pressure in the air chamber 154.

Moreover, the cylinder 160 is provided with a respiration hole 162 and idle striking preventing holes 163, which radially extend through the cylinder 160. A space between the striking housing 157 and the cylinder 160 is connected to the air chamber 154 through the respiration hole 162 and the idle striking preventing holes 163. Further, the respiration hole 162 is disposed between the idle striking preventing holes 163 and the crank shaft 106 in the direction along the central line A1.

Meanwhile, a front cover 164 is fixed to an end portion of the striking housing 157 and on an opposite side to the intermediate case 14. The front cover 164 has a tubular shape. The front cover 164 and the striking housing 157 are arranged concentrically.

Further, a retainer sleeve 165 is attached inside the front cover 164. The retainer sleeve 165 has a cylindrical shape centered on the central line A1, and is disposed so as to extend from inside the front cover 164 to its outside. The tip tool 151 is attached inside the retainer sleeve 165. Additionally, a retainer 166 is provided to prevent the tip tool 151 from coming off the retainer sleeve 165.

Moreover, a cylindrical hammer holder 167 is attached between the retainer sleeve 165 and the cylinder 160 in the front cover 164. The hammer holder 167 does not move in the central line A1 direction. The intermediate striking element 155 is disposed so as to extend through insides of the hammer holder 167 and the retainer sleeve 165. The intermediate striking element 155 can move in the central line A1 direction. The intermediate striking element 155, and the tip tool 151 held by the retainer sleeve 165 can come into contact with each other and separate from each other.

Further, a flange 168 is formed on an outer circumference of the intermediate striking element 155 so as to protrude outside in a radial direction centered on the central line A1. An outer diameter of the flange 168 is larger than an inner diameter of the hammer holder 167. The intermediate striking element 155 is provided with a small-diameter portion 169 at a position close to the striking element 161 with respect to the flange 168 as a boundary, and a large-diameter portion 170 at a position close to the tip tool 151 with respect to the flange 168 as a boundary. The small-diameter portion 169 has a smaller outer diameter than the large-diameter portion 170. The hammer holder 167 holds the large-diameter portion 170.

Also, an annular hammer holder 171 is attached to an outer circumference of the small-diameter portion 169. An inner diameter of the hammer holder 171 is smaller than an outer diameter of the flange 168. The hammer holder 171 does not move relative to the intermediate striking element 155 in the direction along the central line A1. An annular damper 172 and a contact member 173 are attached to an outer circumference of the hammer holder 171. A portion of the contact member 173 is disposed between the cylinder 160 and the striking housing 157. The contact member 173 can move, together with the hammer holder 171, relative to the cylinder 160 in the central line A1 direction. When the contact member 173 comes into contact with an end portion 174 of the cylinder 160 in the central line A1 direction, the movement of the contact member 173 in the central line A1 direction is restricted.

Further, a cylindrical sleeve 175 is attached to an outer circumferential surface of the cylinder 160. The sleeve 175 is made of a magnetic material. The sleeve 175 is disposed concentrically with the cylinder 160, and can move relative to the cylinder 160 in the central line A1 direction. The sleeve 175 moves in the central line A1 direction to open or close the idle striking preventing holes 163. In addition, attached inside the striking housing 157 is a compression coil spring 176. The compression coil spring 176 biases the sleeve 175 in a direction approaching the contact member 173 and in the central line A1 direction. The sleeve 175 biased by a force of the compression coil spring 176 is in contact with the contact member 173.

The handle 15 includes the first tubular portion 15*a* and the second tubular portion 15*b*. The first tubular portion 15*a* is coupled to the mount portion 14*a* through the pivot shaft 80. The impact tool 10 according to the second embodiment also includes the operation restriction mechanism 85.

In addition, the striking housing 157 is provided with a sleeve detection sensor 177. The sleeve detection sensor 177 detects a position of the sleeve 175 in the central line A1 direction and outputs a signal. More specifically, when the sleeve 175 is located at a position of closing the idle striking preventing holes 163, the sleeve detection sensor 177 outputs a signal, whereas when the sleeve 175 is located at a position of opening the idle striking preventing holes 163, the sleeve detection sensor 177 outputs no signal. The impact tool 10 according to the second embodiment can also use the control circuit shown in FIG. 4. The signal outputted from the sleeve detection sensor 177 is inputted to the controller 136.

The operation and control of the impact tool 10 according to the second embodiment will be described next. The force of the compression coil spring 176 is always applied to the hammer holder 171 and the intermediate striking element 155 through the sleeve 175. For this reason, when the tip tool 151 is separate from the object, the flange 168 comes into contact with the hammer holder 167 as shown in FIG. 6, and the intermediate striking element 155 stops. In addition, the sleeve 175 opens the idle striking preventing holes 163. For this reason, the sleeve detection sensor 177 outputs no signal. Moreover, when the tip tool 151 is faced down, the striking element 161 descends under its own weight and stops upon coming into contact with the intermediate striking element 155.

Figure 6:
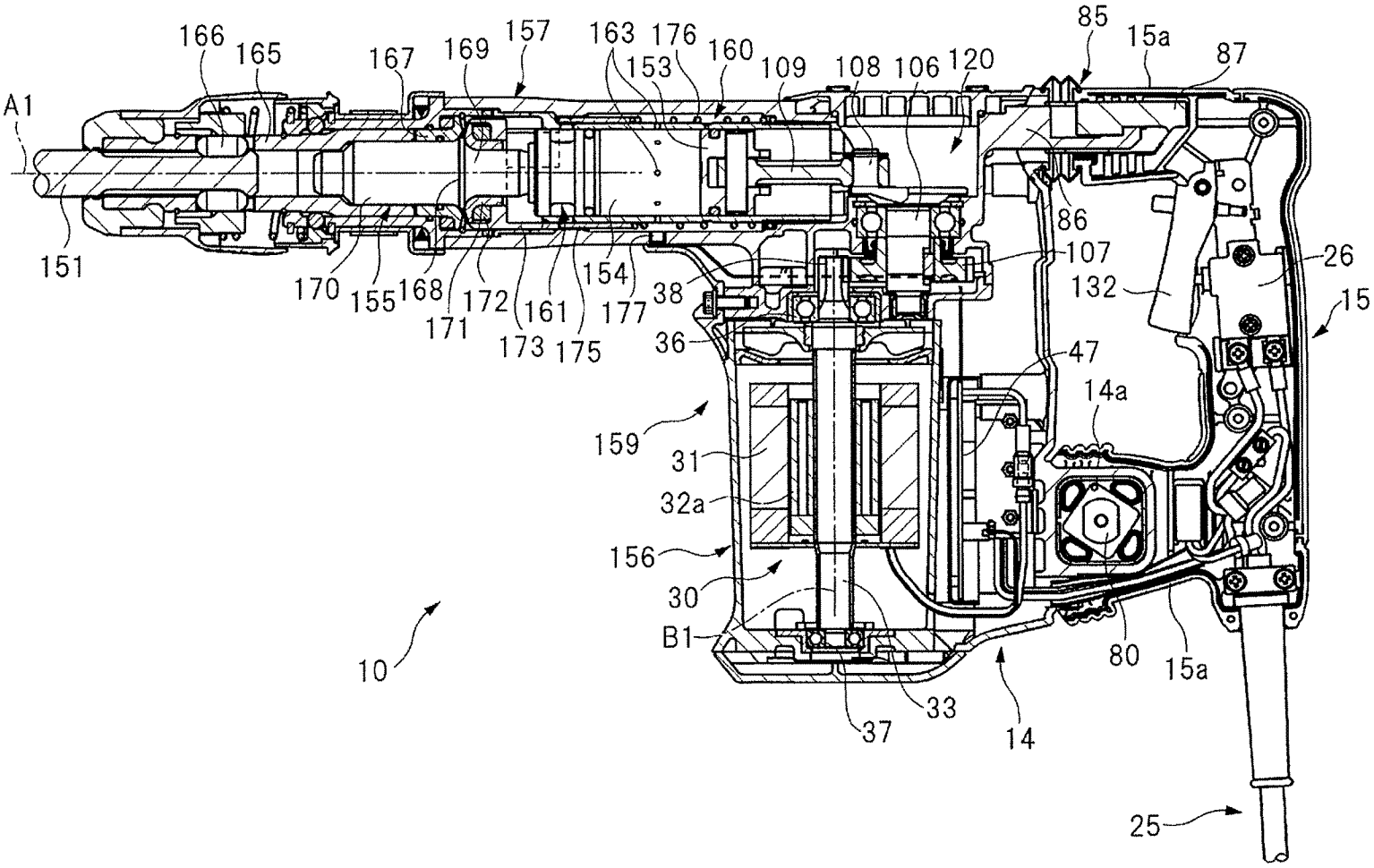
FIG. 6 is a front sectional view of an impact tool according to a second embodiment of the present invention.
Figure 7:
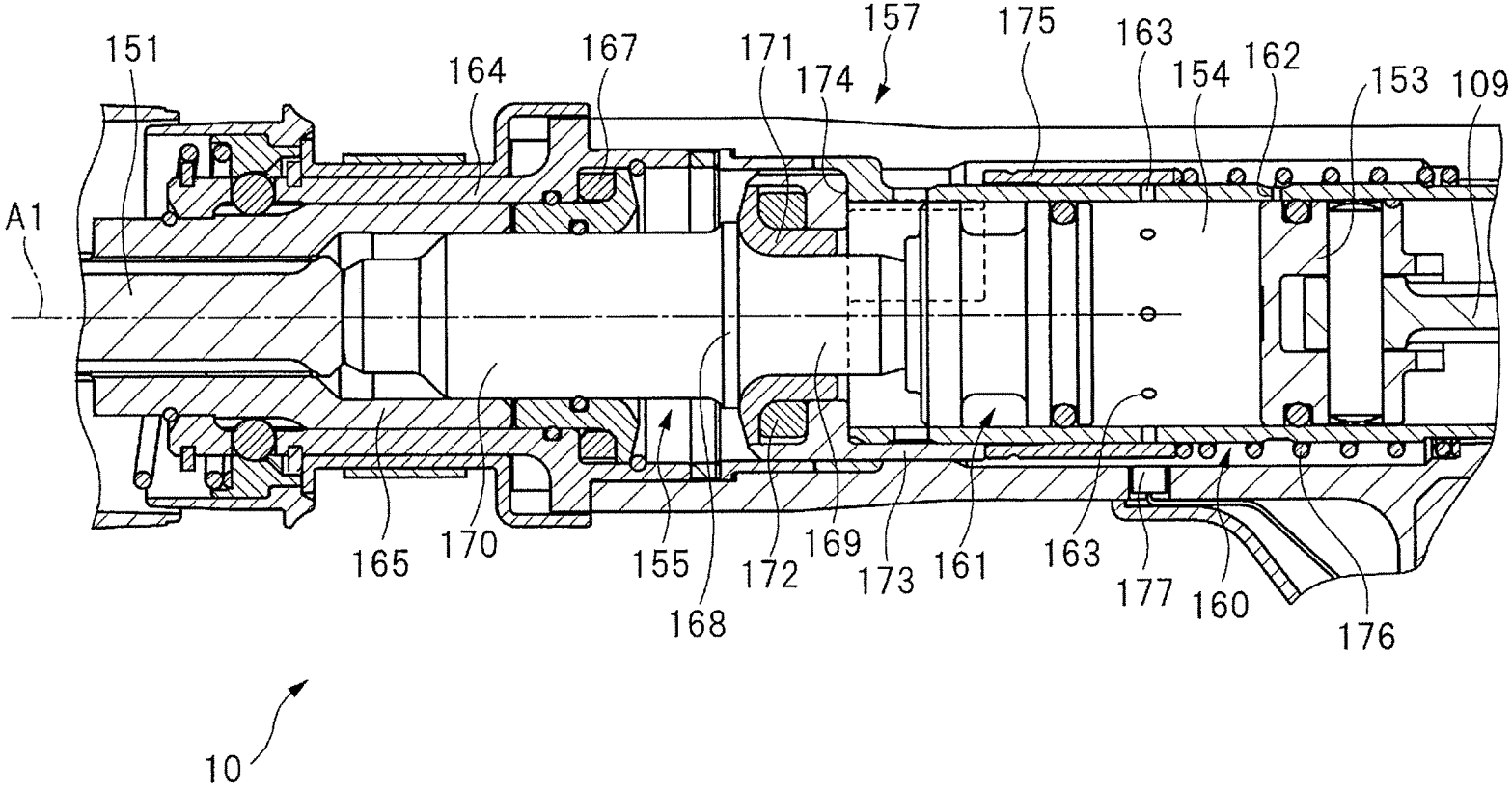
FIG. 7 is a partial front sectional view of the impact tool in FIG. 6.

On the other hand, when the tip tool 151 is separate from the object, the handle 15 of the impact tool 10 in FIG. 6 pivots clockwise about the pivot shaft 80 relative to the tool body 159 and stops in the unpressed state based on the same principle as that of the impact tool 10 in FIG. 1.

Additionally, when the operator turns on the trigger switch 26 by applying an operating force to the trigger 132, the output shaft 33 of the brushless motor 30 rotates. The crank shaft 106 and the connecting rod 109 convert the torque of the output shaft 33 into a reciprocating force for the piston 153. When the idle striking preventing holes 163 are left open, even if the piston 153 reciprocates, the pressure in the air chamber 154 does not rise. That is, no striking force is applied to the tip tool 151, and hence it is possible to prevent idle striking.

In contrast to this, when the operator presses the tip tool 151 against the object by pushing the handle 15, a resultant reactive force causes the tip tool 151 to push the intermediate striking element 155, and the intermediate striking element 155 approaches the piston 153 in the central line A1 direction. Along with an operation of the intermediate striking element 155, the sleeve 175 approaches the piston 153 along the central line A1 against a force of the compression coil spring 176. Additionally, when the contact member 173 comes into contact with the end portion 174 of the cylinder 160, both the intermediate striking element 155 and the hammer holder 171 stop, and the sleeve 175 stops upon closing the idle striking preventing holes 163 as shown in FIG. 7. The sleeve detection sensor 177 outputs a signal when the sleeve 175 closes the idle striking preventing holes 163.

On the other hand, when the operator pushes the handle 15 of the impact tool 10 in FIG. 6, the handle 15 pivots counterclockwise about the pivot shaft 80 in FIG. 6 and stops in the pressed state based on the same principle as that of the impact tool 10 in FIG. 1. In the impact tool 10 in FIG. 6, the proximity sensor 60 also outputs a signal when the handle 15 is in the pressed state.

Subsequently, when the operator turns on the trigger switch 26 and the piston 153 reciprocates with the torque of the brushless motor 30 while the idle striking preventing holes 163 are closed, the pressure in the air chamber 154 increases. Consequently, an operation of striking the tip tool 151 is intermittently repeated through the intermediate striking element 155 by the striking force of the tip tool 151.

Incidentally, when the pressing force applied to the handle 15 is released and the tip tool 151 separates from the object, the force of the compression coil spring 176 causes the intermediate striking element 155 to move in a direction away from the piston 153, and the sleeve 175 opens the idle striking preventing holes 163. Further, when the pressing force applied to the handle 15 is released, the handle 15 pivots clockwise about the pivot shaft 80 relative to the tool body 159 and stops in the unpressed state based on the same principle as that of the impact tool 10 in FIG. 1.

Control Example 2

Figure 8:
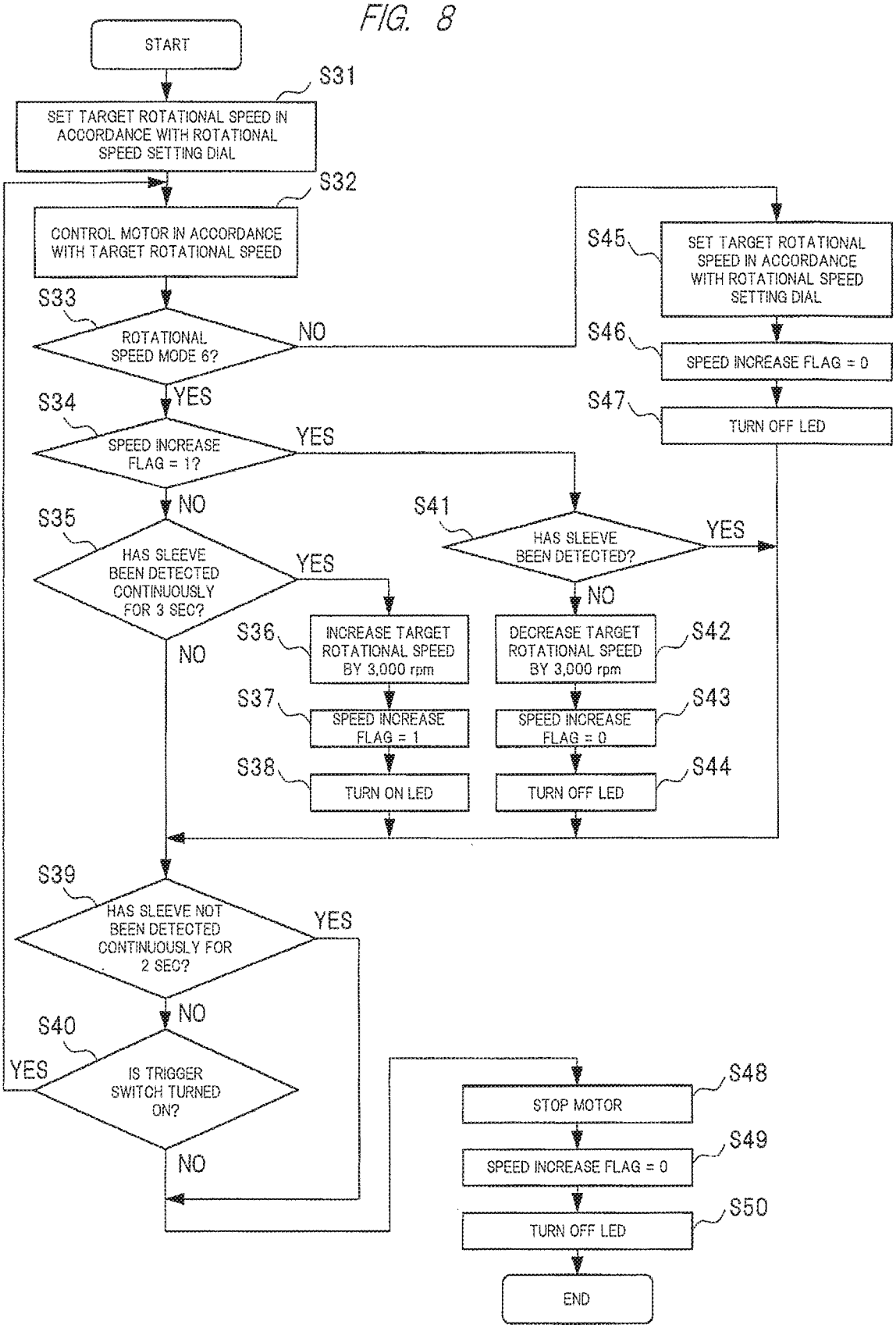
FIG. 8 is a flowchart showing control example 2 which can be executed by the impact tool according to the present invention.

FIG. 8 is a flowchart showing control example 2 which can be executed by the impact tool 10 in FIG. 6. First of all, upon detecting the turning-on of the trigger switch 26, the motor control unit 133 starts the flowchart of FIG. 8. In step S31, the motor control unit 133 sets a target rotational speed for the brushless motor 30 based on a signal from the rotational speed setting dial 51. A process in step S31 is the same as that in step S11.

The motor control unit 133 performs the process in step S32 following step S31. The process in step S32 is the same as that in step S12. In step S33 following step S32, the motor control unit 133 determines whether rotational speed mode 6 is selected. Upon determining YES in step S33, the motor control unit 133 determines in step S34 whether "speed increase flag=1" is satisfied. The meaning of the determination in step S34 is the same as that in step S14.

If the motor control unit 133 determines NO in step S34, the process advances to step S35 to determine whether the sleeve detection sensor 177 has detected continuously the sleeve 175 for 3 sec. A purpose of step S35 is to determine whether the sleeve 175 has continuously closed the idle striking preventing holes 163 for 3 sec. The determination "YES" in step S35 indicates that the idle striking preventing holes 163 have been continuously closed for 3 sec.

Then, if the motor control unit 133 determines YES in step S35, the process advances to step S36 to perform a process in which the target input rotational speed set at that time is increased by 3,000 rpm. Further, the motor control unit 133 also performs a process of setting "speed increase flag=1" in step S37. Simultaneously therewith, the motor control unit 133 performs a process for indicating the execution of speed increase control in step S38. Additionally, the process then advances to step S39, and the motor control unit 133 determines whether the sleeve 175 has not been detected continuously for 2 sec. A purpose of step S39 is to determine whether the idle striking preventing holes 163 are open.

If the motor control unit 133 determines NO in step S39, the process advances to step S40. Then, the determination of NO in step S39 via step S36 after the determination of YES in step S35 means that the tip tool 11 has been continuously pressed against the object. When the process advances to step S32 via steps S36 and S39, the target rotational speed used in step S32 is a target rotational speed increased by 3,000 rpm in step S36.

If the motor control unit 133 determines NO in step S35, the process advances to step S39. The determination of NO in steps S35 and S39 means that the tip tool 11 separated from the object is pressed against the object. As described, when the process advances to step S32 after NO is determined in steps S35 and S39 and YES is determined in step S40, the target rotational speed set in step S31 is used in step S32.

In contrast, if the motor control unit 133 determines YES in step S34, the process advances to step S41 to determine whether the sleeve detection sensor 177 has outputted a signal upon detecting the sleeve 175. If the motor control unit 133 determines YES in step S41, the process advances to step S39.

If the motor control unit 133 determines NO in step S41, the process advances to step S42 to perform a process in which the target rotational speed set at that time is decreased by 3,000 rpm. In addition, the motor control unit 133 sets "speed increase flag=0" in step S43, and turns off the LED lamp in step S44. The process then advances to step S39.

In contrast, if the motor control unit 133 determines NO in step S33, the process advances to step S45 to control the actual rotational speed of the brushless motor 30 based on the target rotational speed set in accordance with the operation of the rotational speed setting dial 51. In addition, the motor control unit 133 sets "speed increase flag=0" in step S46, and turns off the LED lamp in step S47. The process then advances to step S39.

Furthermore, if the motor control unit 133 determines YES in step S39 or NO in step S40, the process advances to step S48 to stop the brushless motor 30. Additionally, the motor control unit 133 sets "speed increase flag=0" in step S49 following step S48, and turns off the LED in step S50. The flowchart of FIG. 8 is finished.

Incidentally, the impact tool 10 in FIG. 6 includes the proximity sensor 60, and hence can execute the flowchart of FIG. 5.

In addition, a structure for opening or closing the idle striking preventing holes 18*a* shown in FIG. 1 using the striking element 22 may be redesigned/modified to have a structure in which the compression coil spring 176, the sleeve 175, the hammer holder 171, the contact member 173, and the sleeve detection sensor 177 as described with reference to FIG. 6 are provided to open or close the idle striking preventing holes 18*a* using the sleeve 175. If this redesign/modification is performed to the impact tool 10 in FIG. 1, the flowchart of FIG. 8 can be executed.

Thus, when the motor control unit 133 executes control example 2, the target rotational speed of the brushless motor 30 in a case where the sleeve 175 continuously closes the idle striking preventing holes 163 for 3 sec is set to be higher than the target rotational speed of the brushless motor 30. Consequently, the same effects as those in control example 1 can be obtained.

Additionally, upon detecting a change from the state of closing the idle striking preventing holes 163 by the sleeve 175 to the state of opening the idle striking preventing holes 163 by the sleeve 175, the motor control unit 133 decreases the target rotational speed of the brushless motor 30. Consequently, the same effects as those in control example 1 can be obtained.

Further, the motor control unit 133 performs control to increase the target rotational speed of the brushless motor 30 as long as rotational speed mode 6 is selected and its maximum is 3,000 rpm settable as the target rotational speed. This can therefore prevent any accidental increase in the target rotational speed of the brushless motor 30.

Moreover, upon detecting the state of continuously closing opening the idle striking preventing holes 163 for a predetermined time, the motor control unit 133 stops the brushless motor 30. This can: certainly prevent an idle striking state in which the intermediate striking element 155 continuously repeats the reciprocation though the idle striking preventing holes 163 are open; improve product lifetime; and suppress power consumption.

Furthermore, an arrangement shown in FIG. 6 enables the speed increase control of the brushless motor 30 without unnecessarily pressing the handle 15 unlike an arrangement shown FIG. 1, and hence can improve the workability.

Control Example 3

Figure 9:
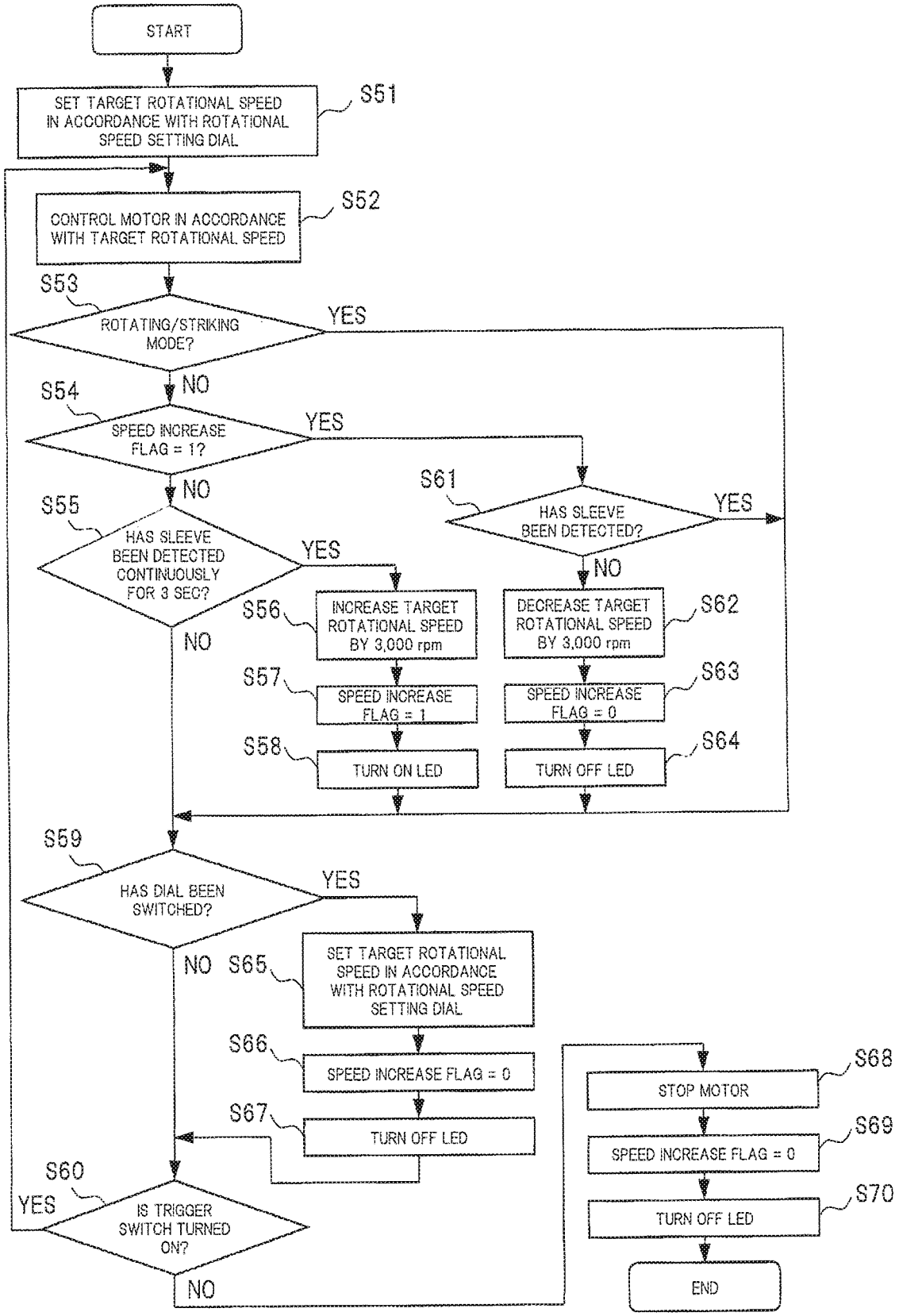
FIG. 9 is a flowchart showing control example 3 which can be executed by the impact tool according to the present invention.

FIG. 9 is a flowchart showing control example 3 executable by modification of design in which the impact tool 10 in FIG. 1 is provided with the compression coil spring 176, the sleeve 175, the hammer holder 171, the contact member 173, and the sleeve detection sensor 177 as described with reference to FIG. 6. Incidentally, when the flowchart of FIG. 9 is described, the reference numerals of the elements provided for the impact tool 10 in FIG. 6 are used appropriately.

First of all, upon detecting the turning-on of the trigger switch 26, the motor control unit 133 starts the flowchart of FIG. 9, and sets the target rotational speed for the brushless motor 30 based on a signal from the rotational speed setting dial 51 in step S51. The process in step S51 is the same as that in step S11.

The motor control unit 133 performs a process in step S52 following step S51. The process in step S52 is the same as that in step S12. In step S53 following step S52, the motor control unit 133 determines whether the rotating/striking mode is selected. Upon determining NO in step S53, the motor control unit 133 determines in step S54 whether "speed increase flag=1" is satisfied. The meaning of the determination in step S54 is the same as that of the determination in step S14.

If the motor control unit 133 determines NO in step S54, the process advances to step S55 to determine whether the sleeve detection sensor 177 has detected continuously the sleeve 175 for 3 sec. The purpose of step S55 is to determine whether the sleeve 175 has continuously closed the idle striking preventing holes 18*a* for 3 sec. The determination of YES in step S55 means that the sleeve 175 has continuously closed the idle striking preventing holes 18*a* for 3 sec.

Then, if the motor control unit 133 determines YES in step S55, the process advances to step S56 to perform a process in which the target input rotational speed set at that time is increased by 3,000 rpm. In addition, the motor control unit 133 performs a process for setting "speed increase flag=1" in step S57, and a process of indicating the execution of the speed increase control in step S58. The process in step S58 is the same as that in step S19. The process then advances to step S59, and the motor control unit 133 determines whether the operator has changed the target rotational speed by operating the rotational speed setting dial 51.

Upon determining NO in step S59, the motor control unit 133 determines in step S60 whether the trigger switch 26 is turned on. If the motor control unit 133 determines YES in step S60, the process advances to step S52. If the process advances to step S52 upon determining NO in step S59 via step S56 and determining YES in step S60, the motor control unit 133 controls the rotational speed of the brushless motor 30 by using the target rotational speed increased in step S56.

In contrast, if the motor control unit 133 determines YES in step S54, the process advances to step S61 to determine whether the sleeve detection sensor 177 has detected the sleeve 175. If the motor control unit 133 determines YES in step S61, the process advances to step S59. If the motor control unit 133 determines NO in step S61, the process advances to step S62 to perform a process in which the target rotational speed set at that time is decreased by 3,000 rpm. In addition, the motor control unit 133 sets "speed increase flag=0" in step S63, and turns off the LED lamp in step S64. The process then advances to step S59.

In contrast, if the motor control unit 133 determines YES in step S59, the process advances to step S65 to control the actual rotational speed of the brushless motor 30 based on the target rotational speed set in accordance with the operation of the rotational speed setting dial 51. In addition, the motor control unit 133 sets "speed increase flag=0" in step S66, and turns off the LED lamp in step S67. The process then advances to step S60. Further, if the motor control unit 133 determines NO in step S55 or YES in step S53, the process advances to step S59.

Moreover, if the motor control unit 133 determines NO in step S60, the process advances to step S68 to stop the brushless motor 30. In addition, the motor control unit 133 sets "speed increase flag=0" in step S69 following step S68, and turns off the LED lamp in step S70. The flowchart of FIG. 9 is finished.

Thus, when the motor control unit 133 performs control example 3, the same effects can be obtained about the same processes as those performed in control example 2. In addition, when the operator sets a new target rotational speed by operating the rotational speed setting dial 51 during the execution of the speed increase control, the motor control unit 133 finishes the speed increase control, and controls the actual rotational speed of the brushless motor 30 based on the new target rotational speed. The motor control unit 133 can therefore change the actual rotational speed of the brushless motor 30 in accordance with an intention of the operator.

Furthermore, when the striking mode is selected, the motor control unit 133 performs the speed increase control, and when the rotating/striking mode is selected, the motor control unit 133 does not perform the speed increase control regardless of the result of detecting the position of the sleeve 175. This can therefore prevent any accidental increase in the actual rotational speed of the brushless motor 30 when the torque is transmitted to the tip tool 11.

Modification 1

Modification 1 in which the flowchart of FIG. 5 is partly modified will be described next. The motor control unit 133 determines in step S15 of FIG. 5 whether the sleeve 175 has been detected continuously for 3 sec, and determines in step S20 of FIG. 5 whether the sleeve 175 is detected. In control due to modification 1, if YES in step S15 is determined, the process advances to step S17, and if NO in step S15 is determined, the process advances to step S16. In addition, if YES in step S20 is determined, the process advances to step S16, and if NO in step S20 is determined, the process advances to step S21. The motor control unit 133 can perform the control due to modification 1 in a structure of providing the sleeve 175 for the impact tool 10 according to the first embodiment, and in the impact tool 10 according to the second embodiment.

Modification 2

Modification 2 in which the flowchart of FIG. 8 is partly modified will be described next. The motor control unit 133 determines in step S35 of FIG. 8 whether the pressed state of the handle 15 has been detected continuously for 3 sec; determines in step S41 of FIG. 8 whether the pressed state of the handle 15 has been detected; and determines in step S39 of FIG. 8 whether the unpressed state of the handle 15 has been detected continuously for 2 sec. In this control due to modification 2, if YES in step S35 is determined, the process advances to step S36, and if NO in step S35 is determined, the process advances to step S39. In addition, if YES in step S41 is determined, the process advances to step S39, and if NO in step S41 is determined, the process advances to step S42. Furthermore, if NO in step S39 is determined, the process advances to step S40, and if YES in step S39 is determined, the process advances to step S48. The motor control unit 133 can perform the control due to modification 2 in the impact tool 10 according to the first embodiment and in the impact tool 10 according to the second embodiment.

Modification 3

Modification 3 in which the flowchart of FIG. 9 is partly modified will be described next. The motor control unit 133 determines in step S55 of FIG. 9 whether the pressed state of the handle 15 has been detected continuously for 3 sec, and determines in step S61 of FIG. 9 whether the pressed state of the handle 15 has been detected. In this control due to modification 3, if YES in step S55 is determined, the process advances to step S56, and if NO in step S55 is determined, the process advances to step S59. In addition, if YES in step S61 is determined, the process advances to step S59, and if NO in step S61 is determined, the process advances to step S62. The motor control unit 133 can perform the control due to modification 3 in a structure of providing the sleeve 175 for the impact tool 10 according to the first embodiment.

Here, a correspondence relationship between each particular described in this embodiment and an arrangement of the present invention will be described. The brushless motor 30 corresponds to the motor according to the present invention. The impact tool 10 corresponds to the impact tool according to the present invention. The tip tool 11 corresponds to the tip tool according to the present invention. The motor control unit 133, the proximity sensor 60, and the sleeve detection sensor 177 correspond to the pressing detection unit according to the present invention. The motor control unit 133 and the inverter circuit 121 correspond to the motor control unit according to the present invention. The rotational speed setting dial 51 and the motor control unit 133 correspond to the target rotational speed setting unit according to the present invention. The tool bodies 12 and 159 each correspond to the casing according to the present invention. The handle 15 corresponds to the handle according to the present invention.

Figure 2:
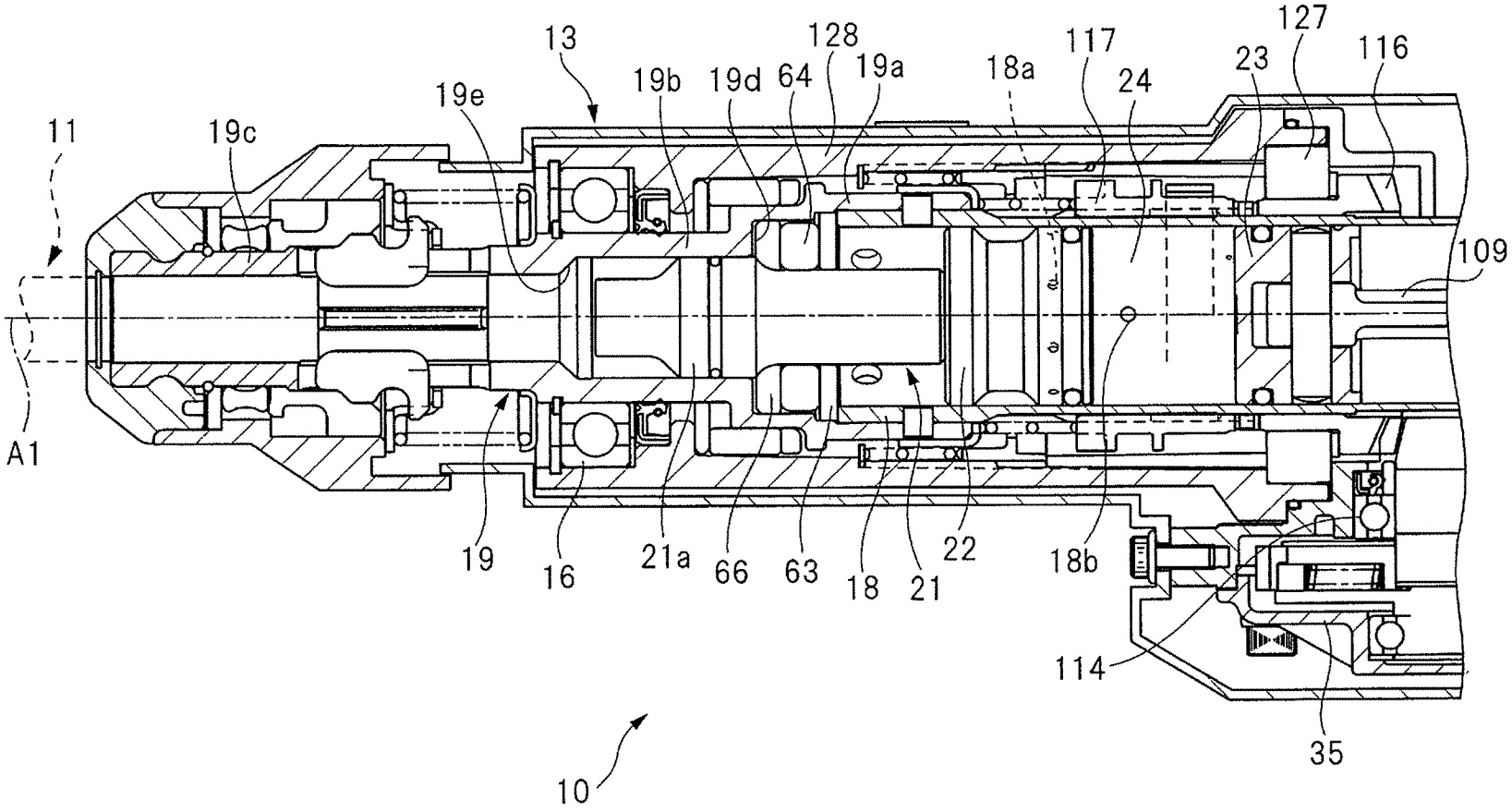
FIG. 2 is a partial front sectional view of the impact tool in FIG. 1.
Figure 3:
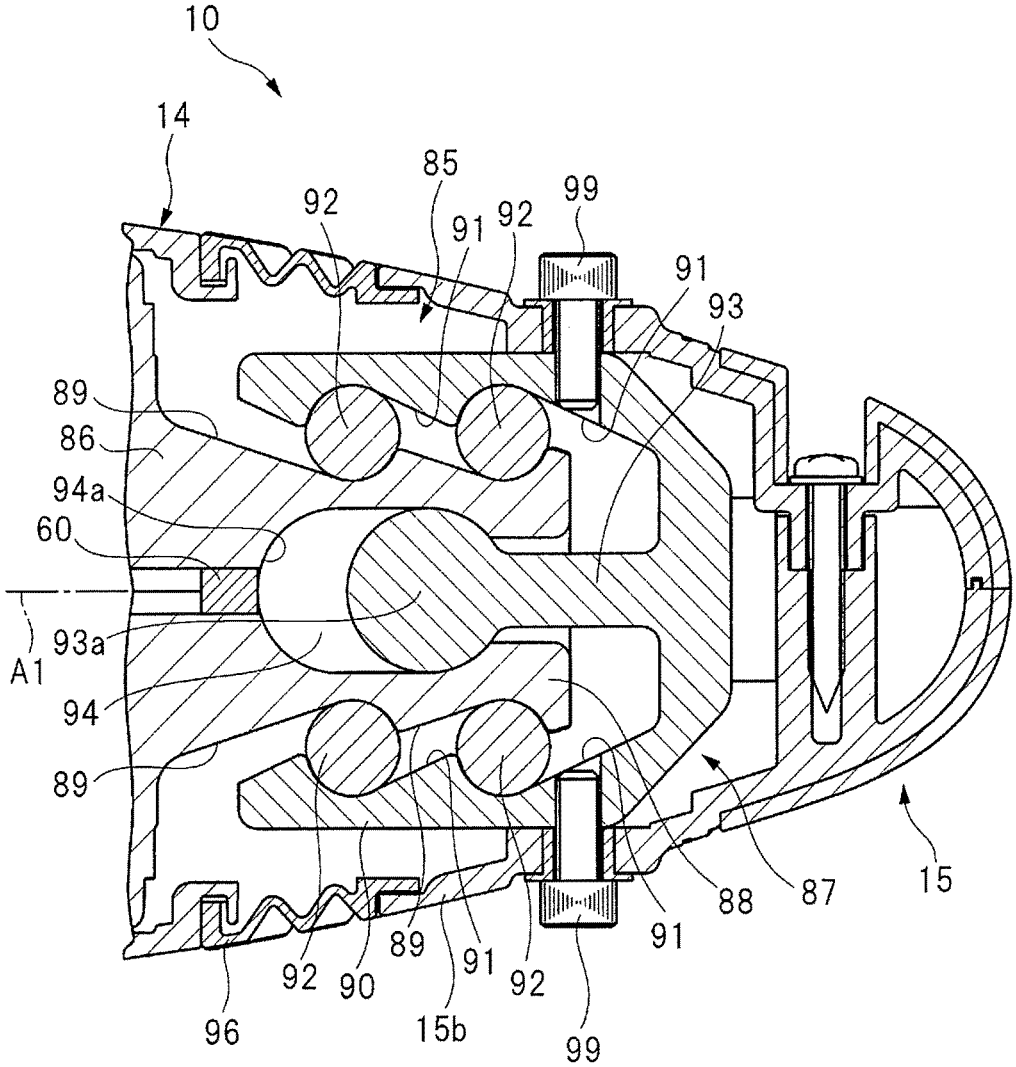
FIG. 3 is a partial plan cross-sectional view of the impact tool along a line in FIG. 1.

In addition, the power conversion mechanism 120, the piston 23, the cylinder 18, the air chamber 24, the idle striking preventing holes 18*a*, the striking element 22, and the intermediate striking element 21 shown in FIGS. 1 and 2 correspond to the impact mechanism according to the present invention. The power conversion mechanism 120, the piston 153, the cylinder 160, the air chamber 154, the idle striking preventing holes 163, the striking element 161, the intermediate striking element 155, and the sleeve 175 shown in FIGS. 6 and 7 correspond to the impact mechanism according to the present invention. The sleeve 175 corresponds to a closing member according to the present invention.

The tool holding tool 19, the torque transmission shaft 110, the driven gear 111, the drive gear 112, the bevel gears 115 and 116, and the sleeve 117 shown in FIGS. 1 and 2 correspond to the power transmission mechanism according to the present invention. The mode switching dial 123, the bevel gear 116, and the sleeve 117 correspond to the working mode switching mechanism according to the present invention.

In addition, the target rotational speed of 18,000 rpm corresponds to "the maximum target rotational speed" according to the present invention. The target rotational speeds of 3,000 rpm, 6,000 rpm, 9,000 rpm, 12,000 rpm, and 15,000 rpm correspond to "values less than the maximum target rotational speed" according to the present invention. Furthermore, "continuously for 3 sec" corresponds to "continuously for a predetermined time" according to the present invention.

The present invention is not limited to the above embodiments and can be variously modified without departing from the scope of the invention. For example, in the impact tools described in the first and second embodiments, the AC power source is supplied, i.e., electric power is supplied to the brushless motor from the AC power source. In contrast to this, the impact tool according to the present invention includes an impact tool, which has a battery pack as a DC power source attached to the tool body and in which electric power of the battery pack is supplied to the brushless motor.

The impact tool according to the first embodiment of the present invention includes the hammer drill and the hammer driver which apply the torque and the striking force in the axial direction to the tip tool. In the present invention, the power conversion mechanism for converting the torque of the motor into the reciprocating force for the piston includes a cam mechanism in addition to a crank mechanism. The motor according to the present invention includes a hydraulic motor, a pneumatic motor, and an internal-combustion engine in addition to the electric motor.

The impact tool according to the present invention includes a structure that allows the handle to pivot within a predetermined angle range relative to the tool body through the pivot shaft, and a structure that allows the handle to linearly slide relative to the tool body. The target rotational speed setting unit according to the present invention includes a technique of steplessly setting the target rotational speed, and a technique of stepwise setting the target rotational speed. When the target rotational speed is stepwise set by the target rotational speed setting unit, the target rotational speed may be set at a fifth step or lower or at a seventh step or higher. In addition, 3 sec as the predetermined time used in the determination step of each flowchart can be arbitrarily changed.

Further, such a structure may be adopted that: a tip-tool sensor for detecting the position of the tip tool in the central line direction, an intermediate-striking-element sensor for detecting the position of the intermediate striking element in the central line direction, or a striking-element sensor for detecting the position of the striking element in the central line direction is provided; and a signal from one of the sensors is inputted to the motor control unit. Additionally, the motor control unit may: determine, based on the signal from one of these sensors, whether the tip tool is pressed against the object; and execute each control example.

REFERENCE SIGNS LIST

10 . . . impact tool; 11 . . . tip tool; 12, 159 . . . tool body; 15 . . . handle; 18, 160 . . . cylinder; 18*a*, 163 . . . idle striking preventing hole; 19 . . . tool holding jig; 21, 155 . . . intermediate striking element; 22, 161 . . . striking element; 23, 153 . . . piston; 24, 154 . . . air chamber; 30 . . . brushless motor; 51 . . . rotational speed setting dial; 60 . . . proximity sensor; 110 . . . torque transmission shaft; 111 . . . driven gear; 112 . . . drive gear; 115, 116 . . . bevel gear; 117, 175 . . . sleeve; 120 . . . power conversion mechanism; 121 . . . inverter circuit; 123 . . . mode switching dial; 133 . . . motor control unit; and 177 . . . sleeve detection sensor.

The invention claimed is:

1. An impact tool comprising:

a pressing detection circuit that makes a detection about whether a tip tool is pressed against an object during rotation of a motor; and a motor control circuit that performs speed increase control for increasing a rotational speed of the motor when a state of pressing the tip tool against the object has been detected continuously for a predetermined time; and a target rotational speed setting interface that sets a target rotational speed for the motor according to an operator's operation, the target rotational speed being within a range of less than or equal to a maximum settable rotational speed, wherein when the target rotational speed is set to the maximum settable rotational speed, the motor control circuit performs the speed increase control so that the rotational speed of the motor exceeds the maximum settable rotational speed, and wherein when the target rotational speed is set to be less than the maximum settable rotational speed, the motor control circuit controls the rotational speed of the motor to be the set target rotational speed without performing the speed increase control.

2. The impact tool according to claim 1, further comprising: a casing that holds the tip tool; and a handle that is gripped by a hand of an operator and moved in two distinct directions, wherein the pressing detection circuit determines that the tip tool is pressed against the object when the handle is operated in a direction approaching the casing.

3. The impact tool according to claim 1, further comprising:

a casing that holds the tip tool; and a striking mechanism that is provided in the casing and converts a torque of the motor into a striking force, wherein the striking mechanism comprises:

a piston that reciprocates by transmission of power of the motor;

a cylinder that reciprocally houses the piston;

an air chamber that is formed in the cylinder and generates a striking force using a reciprocating operation of the piston;

a striking element that is housed in the cylinder and applies a striking force generated by the air chamber to the tip tool;

an idle striking preventing hole that bores through the cylinder and communicates with the air chamber; and a closing member that is provided movably in a direction along a central line of the cylinder, the closing member closes the idle striking preventing hole when the tip tool is pressed against the object, and opens the idle striking preventing hole when the tip tool is separate from the object, and wherein the pressing detection circuit determines that the tip tool is pressed against the object when the closing member closes the idle striking preventing hole.

4. A impact tool comprising:

a pressing detection circuit that makes a detection about whether a tip tool is pressed against an object during rotation of a motor;

a motor control circuit that performs speed increase control for increasing a rotational speed of the motor when a state of pressing the tip tool against the object has been detected continuously for a predetermined time;

a torque transmission mechanism including a plurality of gears and shafts, the torque transmission mechanism that transmits the torque of the motor to the tip tool; and a working mode switching mechanism including a mode switching dial and a plurality of gears, the working mode switching mechanism that switches from one of a rotating/striking mode and a striking mode to the other, the rotating/striking mode applying the striking force to the tip tool and transmitting the torque to the tip tool, the striking mode applying the striking force to the tip tool without transmitting the torque to the tip tool, wherein the motor control circuit performs the speed increase control based on a detection result obtained by the pressing detection circuit when the striking mode is selected, and does not perform the speed increase control even when the detection result is received and obtained by the pressing detection circuit when the rotating/striking mode is selected.

5. The impact tool according to claim 1, wherein when the target rotational speed setting interface sets a new target rotational speed during execution of the speed increase control, the motor control circuit finishes the speed increase control and controls the rotational speed of the motor based on the new target rotational speed.

6. The impact tool according to claim 3, wherein the motor control circuit stops the rotation of the motor when the closing member opens the idle striking preventing hole continuously for a predetermined time.

* * * * *